United States Patent [19]

French

[11] 4,249,681

[45] Feb. 10, 1981

[54] LEAK-PROOF SPRAYER

[75] Inventor: Floyd R. French, Manchester, Mo.

[73] Assignee: The Dow Chemical Company, Midland, Mich.

[21] Appl. No.: 47,404

[22] Filed: Jun. 11, 1979

[51] Int. Cl.[3] ..... F05B 11/00

[52] U.S. Cl. ..... 222/380; 222/321; 222/381; 222/494; 137/510; 239/452; 239/533.13

[58] Field of Search ..... 222/380, 494, 381, 321; 137/510; 417/566; 239/533.13, 452

[56] References Cited

U.S. PATENT DOCUMENTS

| | | | |
|---|---|---|---|
| 1,588,919 | 6/1926 | Telfer | 137/510 X |
| 2,270,794 | 1/1942 | Feldmar | 137/510 X |
| 3,545,682 | 12/1970 | Beard | 239/533.13 X |
| 4,057,176 | 11/1977 | Horvath | 222/384 X |
| 4,161,288 | 7/1979 | McKinney | 239/333 |

*Primary Examiner*—Joseph J. Rolla
*Assistant Examiner*—Frederick R. Handren
*Attorney, Agent, or Firm*—T. R. Wills

[57] ABSTRACT

A manually operated sprayer for dispensing liquids from a container includes an improved, self-sealing outlet check valve having a resilient diaphragm convexed toward and in seating engagement with the dispensing orifice. The diaphragm is designed to flex out of engagement with the dispensing orifice when the pressure of the liquid in the pump chamber exceeds the engaging force of the diaphragm, thereby permitting the liquid in the pump chamber to flow out of the dispensing orifice in an atomized form.

2 Claims, 2 Drawing Figures

LEAK-PROOF SPRAYER

BACKGROUND OF THE INVENTION

The present invention relates to manually operated pumps for dispensing liquids in spray form from containers and, more particularly, to leak-proof dispensing pumps having atomizing outlet check valve means.

Manually operated pumps for dispensing liquids in spray form from containers are well known in the art and are increasing in commercial significance, especially in the United States, due to recent concern over the use of fluorocarbon gases in aerosol dispensers. Considerable difficulty has been encountered, however, in providing a low cost, high compression, manually operated dispensing pump which could be used in those applications which were heretofore satisfied almost exclusively by the aerosol dispensers.

In order to provide a manually operated dispensing pump having sufficient compression to spray the relatively more viscous liquids, and especially to provide the compression needed to dispense such liquids in atomized form, it is essential that the pump be constructed in a fashion which will cause substantially all of the liquid within the compression zone, i.e., the region defined between the inlet and outlet check valves, to be discharged when the pump is actuated. One example of a dispensing pump embodying this concept is disclosed in U.S. Pat. No. 3,913,841.

Another feature desirable in a manually operated dispensing pump is an outlet check valve which is operable to permit liquid to flow from the compression zone to the dispensing orifice only when the pressure of the liquid within the compression zone exceeds a predetermined release pressure of the check valve means, in a fashion analogous to the function of a pressure-relief valve. Such a valve ensures that the spray exiting through the dispensing orifice will have the necessary minimum velocity to prevent undesirable dribbling when the pump is only partially actuated. Such a valve has the further advantage of being self-sealing, i.e., it will prevent leakage from the dispensing orifice when the container is squeezed or inverted. An example of such valve means is embodied in U.S. Pat. No. 3,923,250.

Generally, manually operated dispensing pumps have proven to be relatively expensive by requiring a large number of parts, each individually complex and relatively costly to manufacture and assemble. Those pumps which have achieved the goal of a minimum number of parts, each individually simple and relatively inexpensive to manufacture and assemble, have done so by sacrificing desirable pressure potential. An example of such a pump is described in U.S. Pat. No. 3,749,290. Such pumps have limited utility for the more viscous liquids.

Accordingly, it would be desirable to provide a manually operated dispensing pump having the aforementioned desirable properties. Specifically, it would be desirable to have a leak-proof, low cost, high compression pump adapted to be secured to a container for dispensing a liquid product therefrom.

SUMMARY OF THE INVENTION

The present invention provides an improvement in a manually operated pump adapted to be connected to a container for dispensing a liquid product therefrom, wherein the pump includes variable volume means defining a pump chamber, an inlet passageway providing communication between the pump chamber and a liquid reservoir in the container, an inlet check valve operatively disposed within the inlet passageway for permitting the flow of liquid only from the liquid reservoir to the pump chamber, discharge means defining a dispensing orifice, an outlet passageway providing communication between the dispensing orifice and the pump chamber, and an outlet check valve operatively disposed within the outlet passageway for permitting the flow of liquid only from the pump chamber to the dispensing orifice. In the improved device, the outlet check valve comprises a resilient diaphragm operatively disposed within the outlet passageway adjacent to and convexed toward the dispensing orifice. The diaphragm is in a normal position of tensioned engagement with the dispensing orifice and is adapted to flex out of engagement therewith when the pressure within the pump chamber and the outlet passageway exceeds the engaging force of the diaphragm, whereby liquid is permitted to flow from the pump chamber through the dispensing orifice and into the atmosphere.

Since the improved outlet check valve means of the present invention is disengaged only when the pressure of the fluid within the compression zone exceeds a predetermined minimum pressure, i.e., the engaging force of the diaphragm member, undesirable dribbling is prevented when the pump is only partially actuated. Additionally, this check valve means provides an internal seal in the dispenser which prevents inadvertent leakage from the dispensing orifice and which also prevents drying or evaporation of any liquid remaining in the compression zone when the dispenser is not in use. Furthermore, the improved outlet check valve means is simple in design, requiring only a limited number of inexpensive parts.

DETAILED DESCRIPTION AND PREFERRED EMBODIMENTS

Figure 1:
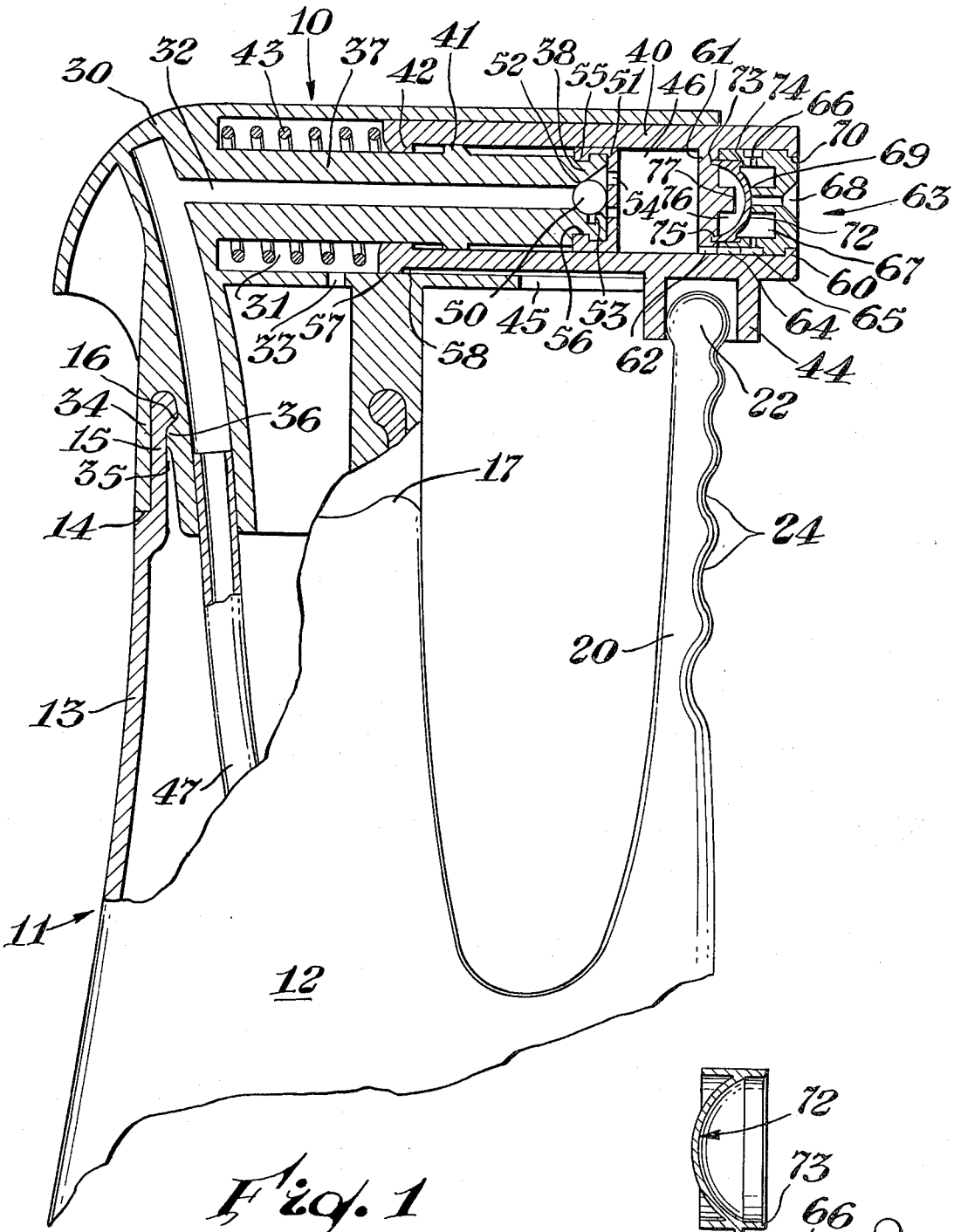
FIG. 1 is an elevation view, partly in section, of a dispensing pump including one embodiment of the outlet check valve in accordance with the present invention.

In the drawings, a manually operated dispensing pump 10 is shown attached to a container 11, which can be used for holding a wide variety of liquids to be dispensed. These liquids can be selected from a wide range of viscosities and can include oil, perfumes, cleaning solutions, and the like. The type of container and means for attaching it to the dispensing pump are not critical. Conventional threaded attaching means can be used, and the container can assume the form of a conventional bottle made from plastic, glass, or other suitable materials.

In a preferred embodiment, the container 11 is a blown plastic bottle including a body 12 and a neck 13. The neck of the bottle includes an annular shoulder 14 defining an inwardly offset cylindrical upper neck section 15, which terminates in a lip 16. The annular shoulder 14 includes a rounded camming portion 17 to assist in separating the dispensing pump from the container when the dispensing pump is rotated relative to the container. The configuration of the camming portion is not critical; preferably, it is shaped to permit separation by rotating the dispenser in either direction. The camming portion 17 is also preferably designed to ensure proper orientation of the dispensing pump on the container relative to an actuator 20.

The actuating means for the dispensing pump may be of any shape or construction, such as a conventional trigger actuator. Preferably, the actuator is designed to permit the gripping force of the entire hand to operate the pump, thereby reducing user fatigue. One example of such an actuator, as shown in FIG. 1, comprises an integrally formed, finger-like extension of the container body 12, having a terminal end 22 in operative association with the dispensing pump 10. Such an actuator is further described in U.S. Pat. No. 4,120,430. To provide a comfortable grasping surface for a user, suitable indentations 24 are formed on the face of an actuator 20.

The dispensing pump 10 includes a pump housing 30 defining an annular bore 31, an inlet passageway 32, and an air vent 33. A circumferential flange 34, the terminal surface of which is shaped complementarily to the annular shoulder 14, depends from the pump housing 30 to define an annular groove 35 for receiving the cylindrical upper neck section 15. When the dispensing pump 10 is fastened to the container 11, an annular detent 36 in the profile of the annular groove 35 frictionally engages the lip 16 of the upper neck section 15 to provide a liquid impervious seal.

The pump housing 30 further defines a stationary, tubular piston 37, which extends axially through the annular bore 31 and terminates in a piston head 38. A reciprocable piston cylinder 40 is operatively disposed within the bore 31 coaxially about the piston 37. A travel limiting stop 41 depends from the piston 37 and interferes with a lip 42, which depends inwardly from the piston cylinder 40, to define the extreme forward position of the piston cylinder 40. A resilient tensioning means 43 is operably disposed within the bore 31 to bias the piston cylinder 40 towards the extreme forward position. An annular flange 44 depends from the piston cylinder at a position remote from the annular bore 31 to define a socket for receiving the terminal end 22 of the actuator 20. A cutout 45 is defined in the pump housing 30 to permit the piston cylinder 40 to reciprocate without causing interference between the annular flange 44 and the pump housing 30.

The piston head 38 and the piston cylinder 40 cooperate to define a variable volume pump chamber 46. The inlet passageway 32 provides communication between the pump chamber 46 and the interior or the liquid reservoir of the container 11 through a dip tube 47. An inlet check valve, including a ball 50 and a resilient retaining means 51 defining perforations 54, is operatively disposed within the inlet passageway 32 to permit the flow of liquid only from the liquid reservoir to the pump chamber 46. The ball 50 seats in a valve seat 52, defined by the piston head 38, with the aid of a small ball-orientating projection 53. The resilient retaining means 51 includes a thickened annular rim 55 that seats in a peripheral groove 56 defined by the piston 37 rearward of the valve seat 52. The resilient retaining means 51 is adapted to retain the ball 50 in near position to the valve seat 52 and also to provide a seal between the piston 37 and the piston cylinder 40 to prevent fluid seepage into the annular bore 31. The interface between the piston cylinder 40 and pump housing 30 (generally depicted by numeral 57) is sealed when the cylinder is in the extreme forward position to prevent leakage when the container is inverted and also to prevent evaporation of the liquid within the container. When the piston cylinder 40 is moved rearward, a longitudinal groove 58 provides communication between the atmosphere and the interior of the container 10 through the air vent 33.

A discharge means, such as a dispenser insert 63, defines a dispensing orifice 68. An insert-retaining rim 60 depends from the piston cylinder 40 to engage a peripheral groove 70 defined by the dispenser insert 63. A stationary partition 61 is provided in the piston cylinder 40 to define the extreme rearward position of the dispenser insert 63. An outlet passageway providing communication between the pump chamber 46 and the dispensing orifice 68 comprises: a conduit 62 defined by partition 61; a longitudinal channel 64 in registered communication with conduit 62; an annular channel 65 communicating with longitudinal channel 64; radially canted ports 66 communicating with annular channel 65; and an insert chamber 67 communicating with ports 66. A resilient diaphragm 72 is operatively disposed within the outlet passageway adjacent to and convexed toward dispensing orifice 68. Normally, the diaphragm 72 is in tensioned engagement with the dispensing orifice 68, i.e., seated in a valve seat 69 defined by the dispenser insert 63, to disrupt communication between the outlet passageway and the dispensing orifice 68. A circumferential rib 73 depends from the diaphragm 72 and engages a groove 74 defined by the dispenser insert 63 and a groove 75 defined by the partition 61, thereby defining a sealed space 76 which is resistant to fluid migration. A spacer element 77 depends forwardly from the partition 61 to limit the travel of the diaphragm 72.

Figure 2:
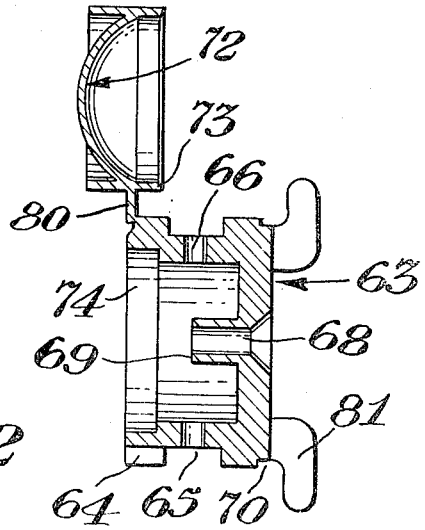
FIG. 2 is an enlarged section view of the outlet check valve in FIG. 1, shown prior to insertion in the completed pump, and including the additional feature of "child-proof" protrusions integral with the outlet check valve assembly.

As shown in FIG. 2, the diaphragm 72 can be integrally molded with the discharge means (i.e., the dispenser insert 63) and flexibly joined thereto by a hinge 80 in a manner such that the diaphragm 72 can be pivoted into engagement with the dispensing orifice 68 prior to press-fitting the dispenser insert 63 into the terminal end of the piston cylinder 40. As further shown in FIG. 2, the dispenser insert 63 can be provided with suitable protrusions 81 to enable the user to selectively rotate the dispenser insert between a first position which permits communication between the dispensing orifice 68 and the pump chamber 46 and a second position which generally precludes such communication, whereby the dispensing pump may be rendered generally inoperable by a young child.

OPERATION

To operate the dispensing pump 10, the actuator 20 is conveniently worked by the user's full hand to permit powerful stroking of the piston cylinder 40. Assuming that the dispensing pump is originally filled with air, stroking of the piston cylinder 40 compresses the air within the outlet passageway and the pump chamber 46 (hereinafter referred to as the "compression zone"). When the pressure of the air within the compression zone exceeds the engaging force of the diaphragm 72, the diaphragm 72 will flex out of engagement with the dispensing orifice 68 and permit the flow of air from the compression zone to the atmosphere. When the user's grip on the actuator is relaxed, the piston cylinder is forced to the extreme forward position by the outward bias of the resilient tensioning means 43. As the piston cylinder starts its return to the forward position, the pressure in the compression zone decreases, which allows the diaphragm 72 to flex back into engagement with the dispensing orifice 68. Further return of the cylinder creates a vacuum in the compression zone, which causes the ball 50 to be disengaged from the valve seat 52, and which simultaneously causes liquid to be drawn into the compression zone from the container 11 through the inlet passageway 32. When the cylinder reaches its extreme forward position, and the vacuum in the compression zone ceases, the ball 50 is again urged into seating engagement with the valve seat 52 by the biasing force of the retaining means 51. Due to the minimal unswept volume within the compression zone of the present dispensing pump, only minimal priming effort is required to fill the compression zone with liquid. Further pumping action by the user will cause liquid to be forced through the dispensing orifice 68 in the manner described earlier for air. As the liquid passes into the insert chamber 67 prior to ultimate expulsion through the dispensing orifice 68, it is subjected to a tangential swirling action created by the radially canted ports 66, which action provides maximum agitation to assist atomization of the liquid.

The improved outlet check valve means as disclosed herein is capable of modification without departing from the scope of the present invention. For example, the configuration of the diaphragm is not critical. It is necessary only that it be operatively disposed within the outlet passageway adjacent to and convexed toward the dispensing orifice to define a "pressure-relief" outlet check valve member. The diaphragm can be constructed of any suitable resilient material, such as plastic or metal, which will not react with the liquids to be dispensed and which can withstand the flexing action described earlier. Additionally, the diaphragm can be molded as an integral appendage of a dispenser insert, as shown in FIG. 2, or it can be separately formed. Furthermore, the engaging force of the diaphragm can be modified to provide the desired minimum threshold liquid exit velocity according to methods known in the art of spring design.

The type and construction of the dispensing pump to be used with the improved outlet check valve means of the present invention is not critical, so long as it can provide the necessary compression force on the liquid to overcome the engaging force of the diaphragm. A piston pump, like that shown in FIG. 1, is preferred since such pumps typically have a higher compression potential than a pump having a resiliently deformable pump chamber, such as a bellows mechanism. Additionally, the dispensing pump can be a finger-actuated, vertically oriented mechanism as well as the hand-actuated, horizontally oriented mechanism like that shown in FIG. 1.

What is claimed is:

1. In a manually operated dispensing pump adapted to be connected to a container for dispensing a liquid product therefrom, wherein the pump includes variable volume means defining a pump chamber, an inlet passageway providing communication between the pump chamber and a liquid reservoir in the container, an inlet check valve operatively disposed within the inlet passageway for permitting the flow of liquid only from the liquid reservoir to the pump chamber, discharge means defining a dispensing orifice, an outlet passageway providing communication between the dispensing orifice and the pump chamber, and an outlet check valve operatively disposed within the outlet passageway for permitting the flow of liquid only from the pump chamber to the dispensing orifice;

the improvement wherein the outlet check valve includes a resilient diaphragm operatively disposed within the outlet passageway adjacent to and convexed toward the dispensing orifice, the diaphragm being normally in tensioned engagement with the dispensing orifice and adapted to flex out of engagement therewith when the pressure within the pump chamber and the outlet passageway exceeds the engaging force of the diaphragm, whereby liquid is permitted to flow from the pump chamber through the dispensing orifice and into the atmosphere; and the discharge means and the diaphragm comprise an integrally molded dispenser insert wherein the diaphragm is joined to the discharge means by a flexible hinge and the diaphragm is pivoted about the hinge to engage the dispensing orifice.

2. The device of claim 1 wherein the dispenser insert is cooperatively connected to the dispensing pump and selectively rotatable between a first position permitting communication between the pump chamber and the dispensing orifice and a second position generally precluding such communication, the dispenser insert including protrusion means for permitting a user to rotate the insert between the first and second positions.

* * * * *